US010227997B2

(12) United States Patent
Hijikata et al.

(10) Patent No.: US 10,227,997 B2
(45) Date of Patent: Mar. 12, 2019

(54) HYDRAULIC DRIVE SYSTEM FOR WORK MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 202 days.

(21) Appl. No.: 15/501,927

(22) PCT Filed: Sep. 16, 2015

(86) PCT No.: PCT/JP2015/076349
§ 371 (c)(1),
(2) Date: Feb. 6, 2017

(87) PCT Pub. No.: WO2016/052209
PCT Pub. Date: Apr. 7, 2016

(65) Prior Publication Data

US 2017/0234334 A1 Aug. 17, 2017

(30) Foreign Application Priority Data

Oct. 2, 2014 (JP) ..... 2014-204348

(51) Int. Cl.
*F15B 11/16* (2006.01)
*F15B 1/26* (2006.01)
(Continued)

(52) U.S. Cl.
CPC ..... *F15B 11/024* (2013.01); *E02F 9/22* (2013.01); *E02F 9/2203* (2013.01);
(Continued)

(58) Field of Classification Search
CPC ..... F15B 11/024; F15B 21/14; F15B 11/0246
(Continued)

(56) References Cited

U.S. PATENT DOCUMENTS

2011/0197576 A1 8/2011 Wada et al.
2012/0304630 A1 12/2012 Kawasaki et al.
(Continued)

FOREIGN PATENT DOCUMENTS

CN 1753831 A 3/2006
CN 102203434 A 9/2011
(Continued)

OTHER PUBLICATIONS

International Preliminary Report on Patentability (PCT/IB/338 & PCT/IB/373) issued in PCT Application No. PCT/JP2015/076349 dated Apr. 13, 2017, including English translation of document C2 (Japanese-language Written Opinion (PCT/ISA/237)) previously submitted on Feb. 6, 2017 (Six (6) pages).
(Continued)

*Primary Examiner* — Thomas E Lazo
*Assistant Examiner* — Daniel S Collins
(74) *Attorney, Agent, or Firm* — Crowell & Moring LLP

(57) ABSTRACT

To provide a hydraulic drive system for a work machine capable of securing a favorable operability in the case where hydraulic fluid discharged from a hydraulic actuator is regenerated for driving other hydraulic actuator. The hydraulic drive system for a work machine includes: a regeneration line that connects a bottom-side hydraulic chamber of a hydraulic cylinder to a portion between a hydraulic pump and a second hydraulic actuator; a regeneration flow rate adjustment device that supplies at least part of the hydraulic fluid discharged from the bottom-side hydraulic chamber to a portion between the hydraulic pump and the second hydraulic actuator through the regeneration
(Continued)

line; a differential pressure calculating section that reads a pressure in the bottom-side hydraulic chamber of the hydraulic cylinder detected by a first pressure sensor and a pressure between the hydraulic pump and the second hydraulic actuator detected by a second pressure sensor, and calculates a differential pressure, or a differential pressure sensor; and a control unit that controls the regeneration flow rate adjustment device such as to gradually increase the flow rate of the hydraulic fluid flowing through the regeneration line according to an increase in the differential pressure calculated by the differential pressure calculation section or in the differential pressure detected by the differential pressure sensor.

9 Claims, 8 Drawing Sheets

(51) Int. Cl.

| | |
|---|---|
| ***F15B 11/024*** | (2006.01) |
| ***E02F 9/22*** | (2006.01) |
| ***F15B 21/14*** | (2006.01) |
| *E02F 3/32* | (2006.01) |
| *E02F 3/42* | (2006.01) |
| *E02F 3/43* | (2006.01) |

(52) U.S. Cl.
CPC ..... *E02F 9/2217* (2013.01); *E02F 9/2221* (2013.01); *E02F 9/2235* (2013.01); *E02F 9/2271* (2013.01); *E02F 9/2296* (2013.01); *F15B 1/26* (2013.01); *F15B 11/16* (2013.01); *F15B 21/14* (2013.01); *E02F 3/32* (2013.01); *E02F 3/425* (2013.01); *E02F 3/435* (2013.01); *E02F 9/2285* (2013.01); *E02F 9/2292* (2013.01); *F15B 2011/0246* (2013.01); *F15B 2211/20546* (2013.01); *F15B 2211/255* (2013.01); *F15B 2211/455* (2013.01); *F15B 2211/6309* (2013.01); *F15B 2211/6346* (2013.01); *F15B 2211/7053* (2013.01); *F15B 2211/71* (2013.01); *F15B 2211/78* (2013.01); *F15B 2211/88* (2013.01)

(58) Field of Classification Search
USPC ..... 60/445
See application file for complete search history.

(56) References Cited

U.S. PATENT DOCUMENTS

| | | | | |
|---|---|---|---|---|
| 2014/0090367 | A1 | 4/2014 | Hijikata et al. | |
| 2014/0102289 | A1* | 4/2014 | Wu ..... | E02F 9/2091 91/466 |
| 2015/0066313 | A1 | 3/2015 | Hirozawa et al. | |

FOREIGN PATENT DOCUMENTS

| | | | |
|---|---|---|---|
| CN | 103597220 | A | 2/2014 |
| CN | 103608526 | A | 2/2014 |
| EP | 1 600 419 | A1 | 11/2005 |
| JP | 60-179504 | A | 9/1985 |
| JP | 2013-53498 | A | 3/2013 |
| JP | 2013-204223 | A | 10/2013 |
| KR | 10-2012-0092173 | A | 8/2012 |
| KR | 10-2014-0021024 | A | 2/2014 |

OTHER PUBLICATIONS

International Search Report (PC/ISA/210) issued in PCT Application No. PCT/JP2015/076349 dated Nov. 24, 2015 with English translation (Three (3) pages).
Japanese-language Written Opinion (PC/ISA/237) issued in PCT Application No. PCT/JP2015/076349 dated Nov. 24, 2015 (Three (3) pages).
Chinese-language Office Action issued in counterpart Chinese Application No. 201580043504.4 dated Oct. 24, 2017 (Six (6) pages).
Korean-language Office Action issued in counterpart Korean Application No. 10-2017-7003467 dated Apr. 2, 2018 (seven (7) pages).

* cited by examiner

HYDRAULIC DRIVE SYSTEM FOR WORK MACHINE

TECHNICAL FIELD

The present invention relates to a hydraulic drive system for a work machine. More particularly, the invention relates to a hydraulic drive system for a work machine, such as a hydraulic excavator, having a regeneration circuit by which hydraulic fluid discharged from a hydraulic actuator due to inertial energy of a driven member (e.g., boom), such as falling of the driven member by its own weight, is reused (regenerated) for driving of another actuator.

BACKGROUND ART

There has been known a hydraulic drive system for a work machine having a regeneration circuit by which hydraulic fluid discharged from a boom cylinder due to falling of a boom by its own weight is regenerated for an arm cylinder, and an example thereof is described in Patent Document 1.

The hydraulic drive system for a work machine described in Patent Document 1 has a control unit by which delivery flow rate of a hydraulic pump is reduced when hydraulic fluid discharged from a boom cylinder is regenerated for an arm cylinder, and engine speed is lowered in the case where delivery flow rate of the hydraulic pump at the time of a combined operation is not more than a prescribed flow rate.

PRIOR ART DOCUMENT

Patent Document

Patent Document 1: JP-2013-204223-A

SUMMARY OF THE INVENTION

Problem to be Solved by the Invention

In the hydraulic drive system according to Patent Document 1, a loss of driving of the hydraulic pump at the time of a combined operation can be suppressed sufficiently. However, when the hydraulic fluid discharged from the boom cylinder is regenerated for the arm cylinder, a regeneration valve may be opened abruptly, thereby producing a shock. The reason will be described below.

In the hydraulic drive system of Patent Document 1, a discharge amount of the hydraulic fluid discharged from the boom cylinder is calculated according to a boom lowering operation amount, a meter-in flow rate of the arm cylinder is calculated according to an arm dumping operation amount, and the smaller one of the calculated values is defined as regeneration flow rate. In addition, the pressure in a bottom-side hydraulic chamber of the boom cylinder and the pressure in a rod-side hydraulic chamber of the arm cylinder are used for calculation of an opening command for a regeneration valve, and a large opening command for flowing of a set regeneration flow rate is calculated when the differential pressure between the two pressures is small. On the other hand, when the differential pressure between the two pressures is great, a command for throttling the regeneration valve opening in a closing direction is calculated such as to prevent the regeneration flow rate from becoming too great.

Here, when a combined operation of simultaneously performing a boom lowering operation and an arm dumping operation is conducted, the pressure in the bottom-side hydraulic chamber of the boom cylinder is lower than the pressure in the rod-side hydraulic chamber of the arm cylinder at the start of motion of ordinary actuators, so that the above-mentioned differential pressure between the two pressures has a negative value. Therefore, the hydraulic fluid discharged from the boom cylinder cannot be regenerated for the arm cylinder, and the regeneration valve remains fully closed.

Thereafter, the pressure in the bottom-side hydraulic chamber of the boom cylinder rises as time passes, so that the above-mentioned differential pressure between the two pressures is switched from a negative value to a positive value. At the time of this switching, the absolute value of the differential pressure is small, and, therefore, a large opening command is outputted to the regeneration valve for flowing of a set regeneration flow rate. As a result, the regeneration valve is controlled to rapidly change from a fully closed state to, for example, a fully opened state. This abrupt switching of the regeneration valve is supposed to induce a pressure shock, which may give the operator an uncomfortable feeling as to operability.

The present invention has been made on the basis of the foregoing. Accordingly, it is an object of the present invention to provide a hydraulic drive system for a work machine by which a favorable operability can be secured in the case where a hydraulic fluid discharged from a hydraulic actuator is regenerated for driving another actuator.

Means for Solving the Problem

To achieve the above object, according to a first-named invention, there is provided a hydraulic drive system for a work machine, including: a hydraulic pump device; a first hydraulic actuator that is supplied with hydraulic fluid from the hydraulic pump device and drives a first driven body; a second hydraulic actuator that is supplied with the hydraulic fluid from the hydraulic pump device and drives a second driven body; a first flow rate adjustment device that controls flow of the hydraulic fluid supplied from the hydraulic pump device to the first hydraulic actuator; a second flow rate adjustment device that controls flow of the hydraulic fluid supplied from the hydraulic pump device to the second hydraulic actuator; a first operation device that outputs an operation signal for commanding an operation of the first driven body to switch over the first flow rate adjustment device; and a second operation device that outputs an operation signal for commanding an operation of the second driven body to switch over the second flow rate adjustment device, the first hydraulic actuator being a hydraulic cylinder that discharges the hydraulic fluid from a bottom-side hydraulic chamber and sucks the hydraulic fluid from a rod-side hydraulic chamber by falling of the first driven body by its own weight when the first operation device is operated in a direction of falling of the first driven body by its own weight, wherein the hydraulic drive system includes: a regeneration line that connects the bottom-side hydraulic chamber of the hydraulic cylinder to a portion between the hydraulic pump device and the second hydraulic actuator, a regeneration flow rate adjustment device that supplies at least part of the hydraulic fluid discharged from the bottom-side hydraulic chamber of the hydraulic cylinder to the portion between the hydraulic pump device and the second hydraulic actuator through the regeneration line; a differential pressure calculation section that reads a pressure in the bottom-side hydraulic chamber of the hydraulic cylinder detected by a first pressure sensor for detecting the pressure in the bottom-side hydraulic chamber of the hydraulic cylinder and a pressure between the hydraulic pump device and the second hydraulic actuator detected by a second pressure sensor for detecting the pressure between the hydraulic pump device and the second hydraulic actuator and calculates a differential pressure, or a differential pressure sensor that detects the differential pressure between the pressure in the bottom-side hydraulic chamber of the hydraulic cylinder and the pressure between the hydraulic pump device and the second hydraulic actuator; and a control unit that controls the regeneration flow rate adjustment device such as to gradually increase the flow rate of the hydraulic fluid flowing through the regeneration line according to an increase in the differential pressure calculated by the differential pressure calculation section or the differential pressure detected by the differential pressure sensor.

Effect of the Invention

According to the present invention, in the case where hydraulic fluid discharged from a hydraulic actuator is regenerated for driving of another hydraulic actuator, the opening of a regeneration valve is adjusted according to the differential pressure between the pressure of the hydraulic fluid discharged from the hydraulic actuator and the pressure of the other hydraulic actuator. Therefore, a switching shock is suppressed, and a favorable operability can be realized.

MODES FOR CARRYING OUT THE INVENTION

Figure 1:
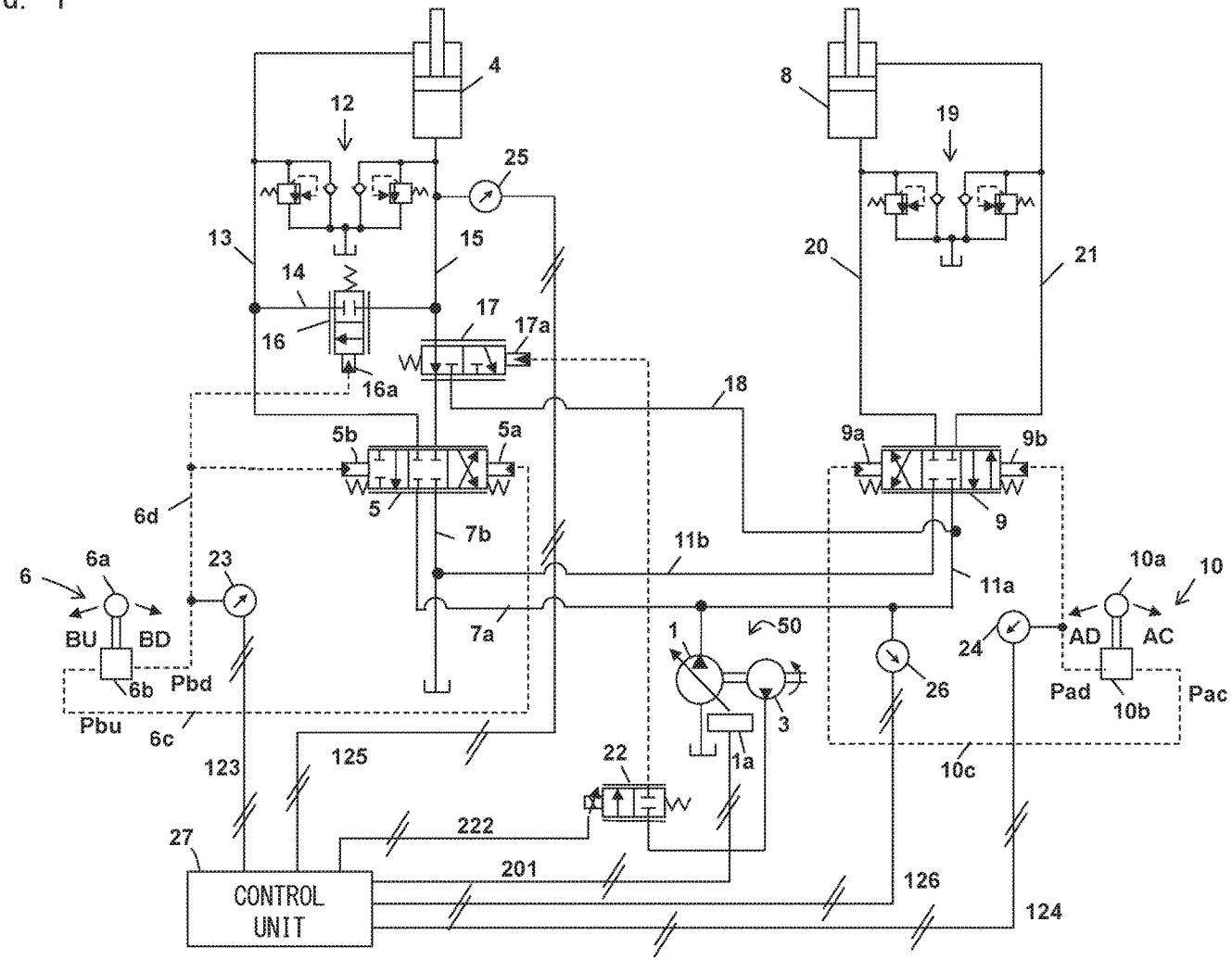
FIG. 1 is a schematic drawing of a control system showing a first embodiment of a hydraulic drive system for a work machine of the present invention.

Embodiments of a hydraulic drive system for a work machine of the present invention will be described below referring to the drawings.

Embodiment 1

FIG. 1 is a schematic drawing of a control system showing a first embodiment of a hydraulic drive system for a work machine of the present invention.

In FIG. 1, the hydraulic drive system in the present embodiment includes: a pump device 50 including a main hydraulic pump 1 and a pilot pump 3; a boom cylinder 4 (first hydraulic actuator) that is supplied with hydraulic fluid from the hydraulic pump 1 and drives a boom 205 (see FIG. 2) of a hydraulic excavator as a first driven body; an arm cylinder 8 (second hydraulic actuator) that is supplied with the hydraulic fluid from the hydraulic pump 1 and drives an arm 206 (see FIG. 2) of the hydraulic excavator as a second driven body; a control valve 5 (first flow rate adjustment device) that controls flow (flow rate and direction) of the hydraulic fluid supplied from the hydraulic pump 1 to the boom cylinder 4; a control valve 9 (second flow rate adjustment device) that controls flow (flow rate and direction) of the hydraulic fluid supplied from the hydraulic pump 1 to the arm cylinder 8; a first operation device 6 that outputs a boom operation command to switch the control valve 5; and a second operation device 10 that outputs an arm operation command to switch the control valve 9. The hydraulic pump 1 is connected also to control valves not shown in the drawing such that the hydraulic fluid is supplied also to other actuators not shown in the drawing, but circuit portions relevant to this configuration is omitted in the drawing.

The hydraulic pump 1 is of the variable displacement type, and has a regulator 1*a* which is a delivery flow rate adjustment device. The regulator 1*a* is controlled by a control signal from a control unit 27 (described later), whereby tilting angle (capacity) of the hydraulic pump 1 is controlled and delivery flow rate is controlled. In addition, though not shown in the drawing, the regulator 1*a*, as well known, has a torque control section to which delivery pressure of the hydraulic pump 1 is introduced and which limits the tilting angle (capacity) of the hydraulic pump 1 such that absorption torque of the hydraulic pump 1 does not exceed a predetermined maximum torque. The hydraulic pump 1 is connected to the control valves 5 and 9 through hydraulic fluid supply lines 7*a* and 11*a*, and the hydraulic fluid delivered from the hydraulic pump 1 is supplied to the control valves 5 and 9.

The control valves 5 and 9, which are flow rate adjustment devices, are respectively connected to bottom-side hydraulic chambers or rod-side hydraulic chambers of the boom cylinder 4 and the arm cylinder 8 through bottom-side lines 15 and 20 or rod-side lines 13 and 21. According to switching positions of the control valves 5 and 9, the hydraulic fluid delivered from the hydraulic pump 1 is supplied to the bottom-side hydraulic chambers or the rod-side hydraulic chambers of the boom cylinder 4 and the arm cylinder 8 from the control valves 5 and 9 through the bottom-side lines 15 and 20 or the rod-side lines 13 and 21. At least part of the hydraulic fluid discharged from the boom cylinder 4 is returned to a tank from the control valve 5 through a tank line 7*b*. The hydraulic fluid discharged from the arm cylinder 8 is entirely returned to the tank from the control valve 9 through a tank line 11*b*.

Note that in the present embodiment, a case wherein the flow rate adjustment device that controls the flow (flow rate and direction) of the hydraulic fluid supplied from the hydraulic pump 1 to each hydraulic actuator 4, 8 is respectively constituted of one control valve 5, 9 is described, but this configuration is not restrictive. The flow rate adjustment device may have a configuration wherein a plurality of valves are provided for supply of hydraulic fluid, or may have a configuration wherein separate valves are provided for supply and discharge of hydraulic fluid.

The first and second operation devices 6 and 10 have operation levers 6*a* and 10*a* and pilot valves 6*b* and 10*b*, respectively. The pilot valves 6*b* and 10*b* are connected to operation sections 5*a* and 5*b* of the control valve 5 and operation sections 9*a* and 9*b* of the control valve 9 through pilot lines 6*c* and 6*d* and pilot lines 10*c* and 10*d*, respectively.

When the operation lever 6*a* is operated in a boom raising direction BU (the leftward direction in the drawing), the pilot valve 6*b* generates an operation pilot pressure Pbu according to the operation amount of the operation lever 6*a*. The operation pilot pressure Pbu is transmitted through the pilot line 6*c* to an operation section 5*a* of the control valve 5, whereby the control valve 5 is switched in a boom raising direction (to a position on the right side in the drawing). When the operation lever 6*a* is operated in a boom lowering direction BD (the rightward direction in the drawing), the pilot valve 6*b* generates an operation pilot pressure Pbd according to the operation amount of the operation lever 6*a*. The operation pilot pressure Pbd is transmitted through the pilot line 6*d* to the operation section 5*b* of the control valve 5, whereby the control valve 5 is switched in a boom lowering direction (to a position on the left side in the drawing).

When the operation lever 10*a* is operated in an arm crowding direction AC (the rightward direction in the drawing), the pilot valve 10*b* generates an operation pilot pressure Pac according to the operation amount of the operation lever 10*a*. The operation pilot pressure Pac is transmitted through the pilot line 10*c* to an operation section 9*a* of the control valve 9, whereby the control valve 9 is switched in an arm crowding direction (to a position on the left side in the drawing). When the operation lever 10*a* is operated in an arm dumping direction AD (the leftward direction in the drawing), the pilot valve 10*b* generates an operation pilot pressure Pad according to the operation amount of the operation lever 10*a*. The operation pilot pressure Pad is transmitted through the pilot line 10*d* to an operation section 9*b* of the control valve 9, whereby the control valve 9 is switched in an arm dumping direction (to a position on the right side in the drawing).

To a portion between the bottom-side line 15 and the rod-side line 13 of the boom cylinder 4 and to a portion between the bottom-side line 20 and the rod-side line 21 of the arm cylinder 8, over-load relief valves with make-up 12 and 19 are connected, respectively. The over-load relief valves with make-up 12 and 19 have a function of preventing hydraulic circuit implements from being damaged due to an excessive rise in pressure in the bottom-side lines 15 and 20 and the rod-side lines 13 and 21, and a function of suppressing the generation of cavitation due to the occurrence of negative pressure in the bottom-side lines 15 and 20 and the rod-side lines 13 and 21.

Note that the present embodiment corresponds to a case wherein the pump device 50 includes one main pump (hydraulic pump 1), but a configuration may also be adopted wherein the pump device 50 includes multiple (for example, two) main pumps, the separate main pumps are connected to the control valves 5 and 9, and hydraulic fluid is supplied to the boom cylinder 4 and the arm cylinder 8 from the separate main pumps.

Figure 2:
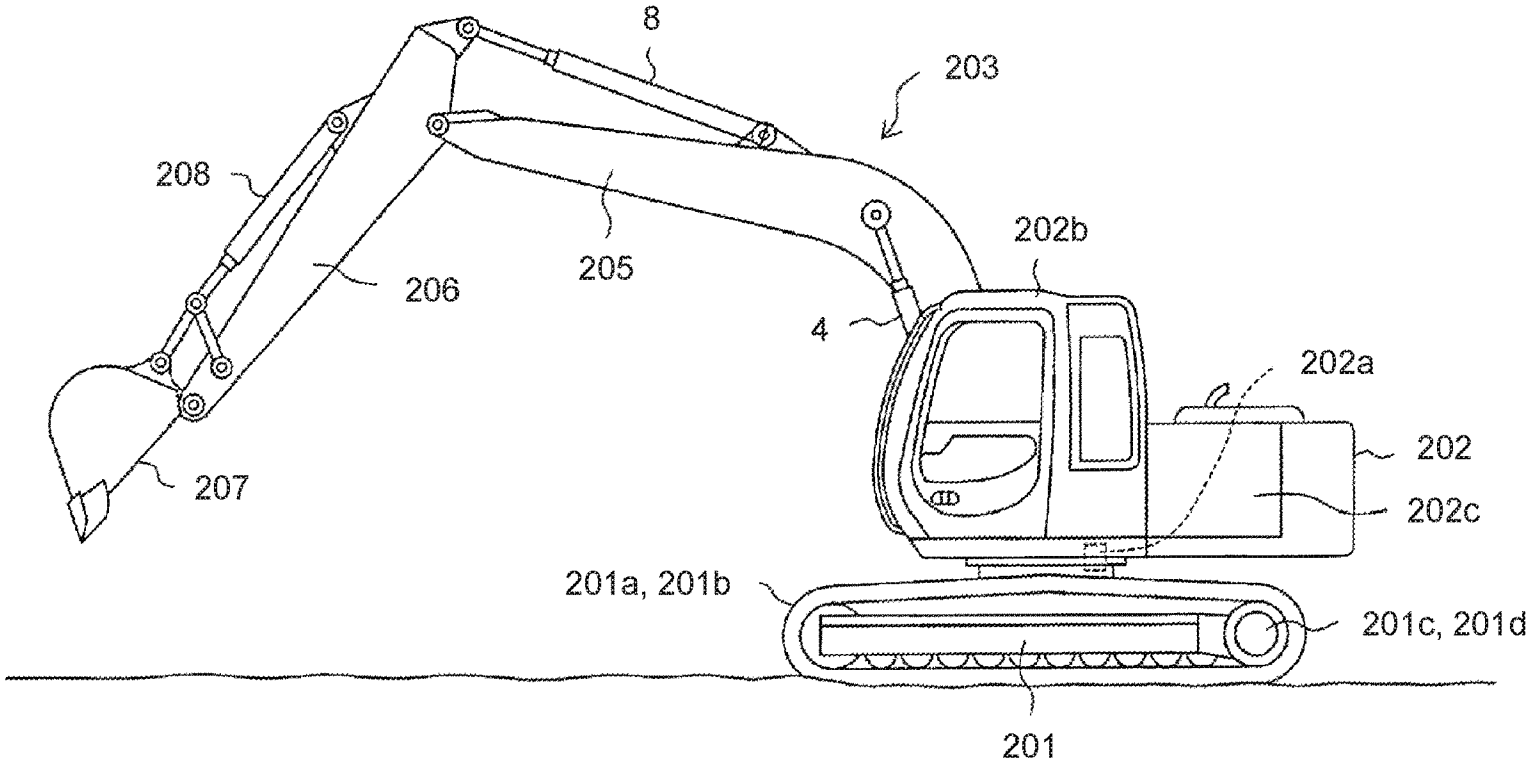
FIG. 2 is a side view of a hydraulic excavator having mounted thereon the first embodiment of the hydraulic drive system for a work machine of the present invention.

FIG. 2 is a side view showing a hydraulic excavator having mounted thereon the first embodiment of the hydraulic drive system for work machine of the present invention.

The hydraulic excavator includes a lower track structure 201, an upper swing structure 202, and a front work implement 203. The lower track structure 201 has left and right crawler type track devices 201*a*, 201*a* (only one of them is shown), which are driven by left and right track motors 201*b*, 201*b* (only one of them is shown). The upper swing structure 202 is swingably mounted on the lower track structure 201, and is driven to swing by a swing motor 202*a*. The front work implement 203 is elevatably mounted to a front portion of the upper swing structure 202. The upper swing structure 202 is provided with a cabin (operation room) 202*b*, and operation devices such as the first and second operation devices 6 and 10 and a travel operation pedal device not shown are disposed in the cabin 202*b*.

The front work implement 203 is an articulated structure having a boom 205 (first driven body), an arm 206 (second driven body), and a bucket 207. The boom 205 is turned up and down in relation to the upper swing structure 202 by extension/contraction of the boom cylinder 4, whereas the arm 206 is turned up and down and forward and rearward in relation to the boom 205 by extension/contraction of the arm cylinder 8, and the bucket 207 is turned up and down and forward and rearward in relation to the arm 206 by extension/contraction of a bucket cylinder 208.

In FIG. 1, circuit portions associated with hydraulic actuators such as the left and right track motors 201*b*, 201*b*, the swing motor 202*a*, and the bucket cylinder 208 are omitted.

Here, the boom cylinder 4 is a hydraulic cylinder that discharges the hydraulic fluid from a bottom-side hydraulic chamber and sucks the hydraulic fluid from a rod-side hydraulic chamber by falling of the front work implement 203 inclusive of the boom 205 by its own weight when the operation lever 6*a* of the first operation device 6 is operated in a boom lowering direction (the falling direction of the first driven body by its own weight) BD.

Returning to FIG. 1, the hydraulic drive system of the present invention includes, in addition to the above-mentioned components: a 2-position 3-port regeneration control valve 17 which is disposed in the bottom-side line 15 of the boom cylinder 4 and by which the flow rate of the hydraulic fluid discharged from the bottom-side hydraulic chamber of the boom cylinder 4 is adjustably distributed to the control valve 5 side (the tank side) and the side of the hydraulic fluid supply line 11*a* of the arm cylinder 8 (the regeneration line side); a regeneration line 18 connected on one side thereof to an outlet port on one side of the regeneration control valve 17 and connected on the other side thereof to the hydraulic fluid supply line 11*a*; a communication line 14 branched respectively from the bottom-side line 15 and the rod-side line 13 of the boom cylinder 4 and interconnects the bottom-side line 15 and the rod-side line 13; a communication control valve 16 which is disposed in the communication line 14, is opened based on an operation pilot pressure Pbd (operation signal) in the boom lowering direction BD of the first operation device 6, regenerates and supplies a portion of the hydraulic fluid discharged from the bottom-side hydraulic chamber of the boom cylinder 4 to the rod-side hydraulic chamber of the boom cylinder 4, and provides communication between the bottom-side hydraulic chamber and the rod-side hydraulic chamber of the boom cylinder 4 to thereby prevent a negative pressure from being generated in the rod-side hydraulic chamber; a solenoid proportional valve 22; pressure sensors 23, 24, 25 and 26; and the control unit 27.

The regeneration control valve 17 has a tank-side line (first restrictor) and a regeneration-side line (second restrictor) such that the hydraulic fluid discharged from the bottom-side hydraulic chamber of the boom cylinder 4 can be made to flow to the tank side (the control valve 5 side) and the regeneration line 18 side. The stroke of the regeneration control valve 17 is controlled by the solenoid proportional valve 22. An outlet port on the other side of the regeneration control valve 17 is connected with a port of the control valve 5. In the present embodiment, the regeneration control valve 17 constitutes: a regeneration flow rate adjustment device by which at least part of the hydraulic fluid discharged from the bottom-side hydraulic chamber of the boom cylinder 4 is supplied, at an adjusted flow rate, to a portion between the hydraulic pump 1 and the arm cylinder 8 through the regeneration line 18; and a discharge flow rate adjustment device by which at least part of the hydraulic fluid discharged from the bottom-side hydraulic chamber of the boom cylinder 4 is discharged, at an adjusted flow rate, to the tank.

The communication control valve 16 has an operation section 16*a*, and is opened by transmission of the operation pilot pressure Pbd in the boom lowering direction BD of the first operation device 6 to the operation section 16*a*.

The pressure sensor 23 is connected to the pilot line 6*d*, and detects the operation pilot pressure Pbd in the boom lowering direction BD of the first operation device 6; the pressure sensor 25 is connected to the bottom-side line 15 of the boom cylinder 4, and detects the pressure in the bottom-side hydraulic chamber of the boom cylinder 4; and the pressure sensor 26 is connected to the hydraulic fluid supply line 11*a* on the arm cylinder 8 side, and detects the delivery pressure of the hydraulic pump 1. The pressure sensor 24 is connected to the pilot line 10*d* of the second operation device 10, and detects the operation pilot pressure Pad in an arm dumping direction of the second operation device 10.

The control unit 27 accepts as inputs detection signals 123, 124, 125, and 126 from the pressure sensors 23, 24, 25, and 26, performs predetermined calculations based on the signals, and outputs a control command to the solenoid proportional valve 22 and the regulator 1*a*.

The solenoid proportional valve 22 is operated by the control command from the control unit 27. The solenoid proportional valve 22 converts the hydraulic fluid supplied from the pilot pump 3 into a desired pressure, and outputs the desired pressure to an operation section 17*a* of the regeneration control valve 17 to control the stroke of the regeneration control valve 17, thereby controlling the opening (opening area).

Figure 3:
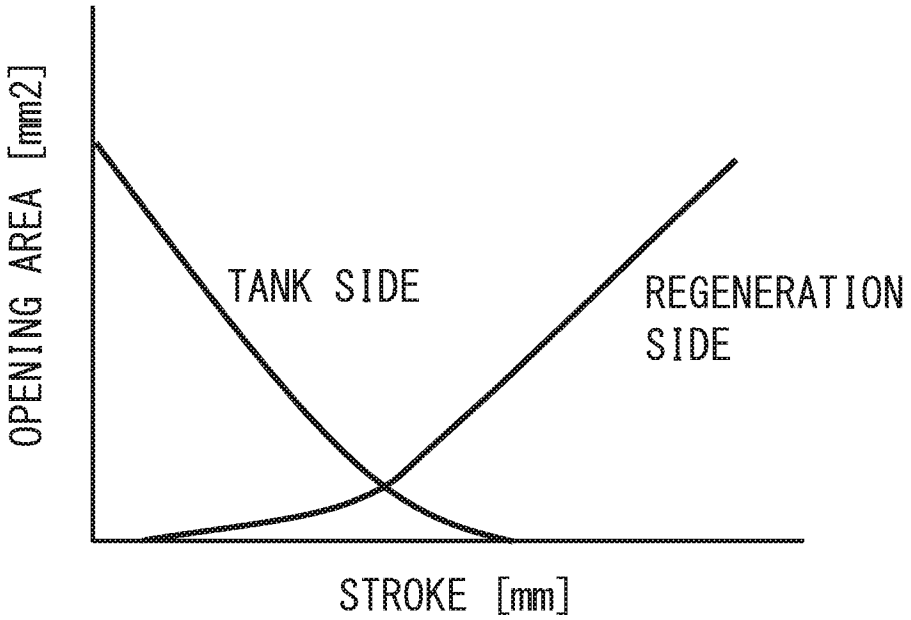
FIG. 3 is a characteristic diagram showing opening area characteristic of a regeneration control valve constituting the first embodiment of the hydraulic drive system for a work machine of the present invention.

FIG. 3 is a characteristic diagram showing opening area characteristic of the regeneration control valve constituting the first embodiment of the hydraulic drive system for a work machine of the present invention. In FIG. 3, the horizontal axis represents spool stroke of the regeneration control valve 17, and the vertical axis represents the opening area.

In FIG. 3, in the case where the spool stroke is at a minimum (in the case where the spool is in a normal position), a tank-side line is open and its opening area is at a maximum, whereas a regeneration-side line is closed and its opening area is zero. As the stroke is gradually increased, the opening area of the tank-side line gradually decreases, while the opening area of the regeneration-side line gradually increases. When the stroke is further increased, the tank-side line is closed (its opening area is reduced to zero), and the opening area of the regeneration line increases further. As a result of such a configuration, in the case where the spool stroke is at a minimum, the hydraulic fluid discharged from the bottom-side hydraulic chamber of the boom cylinder 4 wholly flows to the control valve 5 side, without being regenerated, and, when the stroke is gradually moved rightward, a portion of the hydraulic fluid discharged from the bottom-side hydraulic chamber of the boom cylinder 4 flows into the regeneration line 18. In addition, by adjusting the stroke, the opening areas of the tank-side line and the regeneration-side line 18 can be varied, and the regeneration flow rate can be controlled.

Operations conducted in the case where only boom lowering is performed will be outlined below.

In FIG. 1, where the operation lever 6*a* of the first operation device 6 is operated in the boom lowering direction BD, the operation pilot pressure Pbd generated from the pilot valve 6*b* of the first operation device 6 is inputted to the operation section 5*b* of the control valve 5 and the operation section 16*a* of the communication control valve 16. As a result, the control valve 5 is switched to a position on the left side in the figure, and the bottom line 15 comes to communicate with the tank line 7*b*, whereby hydraulic fluid is discharged from the bottom-side hydraulic chamber of the boom cylinder 4 to the tank, and a piston rod of the boom cylinder 4 performs a shrinking operation (boom lowering operation).

Furthermore, the communication control valve 14 is switched to a communication position on the lower side in the figure, whereby the bottom-side line 15 of the boom cylinder 4 is put into communication with the rod-side line 13, and a portion of the hydraulic fluid discharged from the bottom-side hydraulic chamber of the boom cylinder 4 is supplied to the rod-side hydraulic chamber of the boom cylinder 4. As a result, generation of a negative pressure in the rod-side hydraulic chamber is prevented, and it becomes unnecessary to supply the hydraulic fluid from the hydraulic pump 1, so that output power of the hydraulic pump 1 is suppressed and fuel cost can be reduced.

Operations conducted in the case where both boom lowering and arm driving are performed simultaneously will be outlined below. Note that the same principle applies to the case of arm dumping and the case of arm crowding, and, therefore, the following description will be made by taking an arm dumping operation as an example.

When the operation lever 6*a* of the first operation device 6 is operated in the boom lowering direction BD and simultaneously the operation lever 10*a* of the second operation device 10 is operated in the arm dumping direction AD, the operation pilot pressure Pbd generated from the pilot valve 6*b* of the first operation device 6 is inputted to the operation section 5*b* of the control valve 5 and the operation section 16*a* of the communication control valve 16. As a result, the control valve 5 is switched to a position on the left side in the figure, and the bottom line 15 comes to communicate with the tank line 7*b*, whereby the hydraulic fluid is discharged from the bottom-side hydraulic chamber of the boom cylinder 4 to the tank, and the piston rod of the boom cylinder 4 performs a shrinking operation (boom lowering operation).

The operation pilot pressure Pad generated from the pilot valve 10*b* of the second operation device 10 is inputted to the operation section 9*b* of the control valve 9. As a result, the control valve 9 is switched, to make communication between the bottom line 20 and the tank line 11*b* and communication between the rod line 21 and the hydraulic fluid supply line 11*a*, whereby the hydraulic fluid in the bottom-side hydraulic chamber of the arm cylinder 8 is discharged to the tank, and the hydraulic fluid delivered from the hydraulic pump 1 is supplied to the rod-side hydraulic chamber of the arm cylinder 8. Consequently, a piston rod of the arm cylinder 8 performs a shrinking operation.

To the control unit 27, detection signals 123, 124, 125, and 126 from the pressure sensors 23, 24, 25, and 26 are inputted. By the function of a control logic which will be described later, the control unit 27 outputs control commands to the solenoid proportional valve 22 and the regulator 1*a* of the hydraulic pump 1.

The solenoid proportional valve 22 generates a control pressure according to the control command, the regeneration control valve 17 is controlled by the control pressure, and a portion or the whole of the hydraulic fluid discharged from the bottom-side hydraulic chamber of the boom cylinder 4 is regenerated and supplied to the arm cylinder 8 through the regeneration control valve 17.

The regulator 1*a* of the hydraulic pump 1 controls the tilting angle of the hydraulic pump 1 based on the control command, and appropriately controls pump flow rate in such a manner as to keep a target speed of the arm cylinder 8.

Control functions of the control unit 27 will be described below. The control unit 27 generally has the following two functions.

First, when the first operation device 6 is operated in the boom lowering direction BD, which is the direction of falling of the boom 205 (first driven body) by its own weight, and the second operation device 10 is operated simultaneously therewith, the control unit 27 switches the regeneration control valve 17 from the normal position if the pressure in the bottom-side hydraulic chamber of the boom cylinder 4 is higher than the pressure in the hydraulic fluid supply line 11*a* between the hydraulic pump 1 and the arm cylinder 8, whereby the hydraulic fluid discharged from the bottom-side hydraulic chamber of the boom cylinder 4 is regenerated into the rod-side hydraulic chamber of the arm cylinder. The control unit 27 has a differential pressure calculation section for calculating the differential pressure between the pressure in the bottom-side hydraulic chamber of the boom cylinder 4 and the pressure in the hydraulic fluid supply line 11*a* between the hydraulic pump 1 and the arm cylinder 8, and controls the opening of the regeneration control valve 17 according to the differential pressure calculated by the differential pressure calculation section (first function).

Specifically, when the differential pressure calculated by the differential pressure calculation section is small, the control unit 27 reduces the stroke of the regeneration control valve 17, whereby the opening area of the regeneration-side line is throttled, and the opening area of the tank-side line is enlarged. As the differential pressure increases, the control unit 27 enlarges the opening area of the regeneration-side line, and throttles the opening area of the tank-side line. When the differential pressure is higher than a predetermined value, the control unit 27 performs a control such as to maximize the opening area of the regeneration-side line and close the tank-side opening. By such a control, a switching shock at the regeneration control valve 17 is suppressed.

In the case where boom lowering and arm driving are performed simultaneously, the differential pressure is small at the start of the process, and the differential pressure increases as time passes. With the opening area of the regeneration-side line gradually enlarged according to the differential pressure, therefore, the switching shock can be suppressed, and a favorable operability can be realized.

Furthermore, in the case where the differential pressure is small, regeneration flow rate is small even if the regeneration-side opening is enlarged, and, for this reason, the speed of the piston rod of the boom cylinder may be lowered. In view of this, where the differential pressure is small, a control is performed such that the opening area of the tank-side line is enlarged to increase the discharge flow rate from the bottom-side hydraulic chamber, thereby bringing the speed of the piston rod of the boom cylinder to a speed desired by the operator. On the other hand, where the differential pressure is great, the regeneration flow rate is sufficiently high, and, in view of this, the opening of the tank-side line is reduced, whereby the speed of the piston rod of the boom cylinder is prevented from becoming too high.

In addition, at the time of controlling the regeneration control valve 17 to supply hydraulic fluid from the bottom-side hydraulic chamber of the boom cylinder 4 to the hydraulic fluid supply line 11*a* between the hydraulic pump 1 and the arm cylinder 8, the control unit 27 performs such a control as to reduce the capacity of the hydraulic pump 1 by an amount according to the regeneration flow rate at which the hydraulic fluid is supplied from the bottom-side hydraulic chamber of the boom cylinder 4 to the hydraulic fluid supply line 11*a* (second function).

Figure 4:
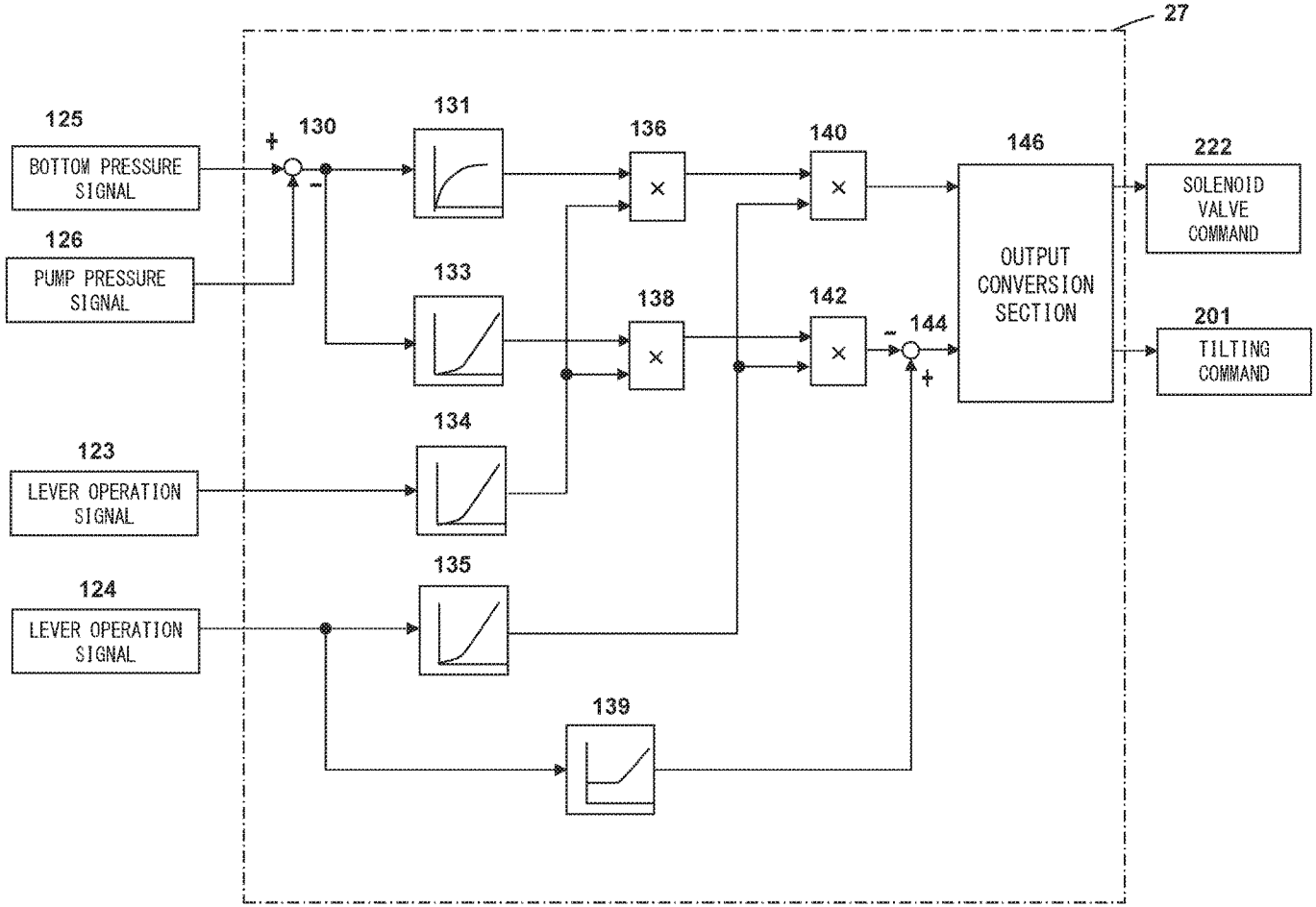
FIG. 4 is a block diagram of a control unit constituting the first embodiment of the hydraulic drive system for a work machine of the present invention.

FIG. 4 is a block diagram of the control unit constituting the first embodiment of the hydraulic drive system for a work machine of the present invention.

As shown in FIG. 4, the control unit 27 includes an adder 130, a function generator 131, a function generator 133, a function generator 134, a function generator 135, a multiplier 136, a multiplier 138, a function generator 139, a multiplier 140, a multiplier 142, an adder 144, and an output conversion section 146.

In FIG. 4, a detection signal 123 is a signal (lever operation signal) obtained by detection of the operation pilot pressure Pbd in the boom lowering direction of the operation lever 6*a* of the first operation device 6 by the pressure sensor 23. A detection signal 124 is a signal (lever operation signal) obtained by detection of the operation pilot pressure Pad in the arm dumping direction of the operation lever 10*a* of the second operation device 10 by the pressure sensor 24. A detection signal 125 is a signal (bottom pressure signal) obtained by detection of the pressure in the bottom-side hydraulic chamber of the boom cylinder 4 (the pressure in the bottom-side line 15) by the pressure sensor 25. A detection signal 126 is a signal (pump pressure signal) obtained by detection of the delivery pressure of the hydraulic pump 1 (the pressure in the hydraulic fluid supply line 11*a*) by the pressure sensor 26.

The bottom pressure signal 125 and the pump pressure signal 126 are inputted to the adder 130 as a differential pressure calculation section, in which the deviation between the bottom pressure signal 125 and the pump pressure signal 126 (the differential pressure between the pressure in the bottom-side hydraulic chamber of the boom cylinder 4 and the delivery pressure of the hydraulic pump 1) is determined, and this differential pressure signal is inputted to the function generator 131 and the function generator 132.

The function generator 131 calculates an opening area of the regeneration-side line of the regeneration control valve 17 according to the differential pressure signal obtained at the adder 130, and its characteristic is set based on the opening area characteristic of the regeneration control valve 17 shown in FIG. 3. Specifically, when the differential pressure is small, the stroke of the regeneration control valve 17 is reduced, whereby the opening area of the regeneration-side line is throttled, and the opening area of the tank-side line is enlarged. On the other hand, when the differential pressure is great, the opening area of the regeneration-side line is enlarged, and when the differential pressure reaches a predetermined value, the opening area of the regeneration-side line is maximized, and the opening of the tank-side line is closed.

The function generator 133 determines a reduction flow rate (hereinafter referred to as pump reduction flow rate) of the hydraulic pump 1 according to the differential pressure signal obtained by the adder 130. Owing to the characteristic of the function generator 131, the opening area of the regeneration-side line is enlarged and the regeneration flow rate increases as the differential pressure increases. In view of this, a setting is made such that the pump reduction flow rate also increases as the differential pressure increases.

The function generator 134 calculates a coefficient to be used in the multiplier according to the lever operation signal 123 of the first operation device 6. The function generator 134 outputs a minimum value of 0 when the lever operation signal 123 is 0, increases its output as the lever operation signal 123 increases, and outputs 1 as a maximum value.

The multiplier 136 accepts as inputs the opening area calculated by the function generator 131 and the value calculated by the function generator 134, and outputs a multiplied value as an opening area. Here, in the case where the lever operation signal 123 of the first operation device 6 is small, it is necessary to lower the piston rod speed of the boom cylinder 4, and, therefore, it is required to reduce the regeneration flow rate as well. For this reason, the function generator 134 outputs a small value within the range of 0 to 1 and outputs the opening area calculated by the function generator 131 as a further reduced value.

On the other hand, in the case where the lever operation signal 123 of the first operation device 6 is large, it is necessary to raise the piston rod speed of the boom cylinder 4, and, therefore, the regeneration flow rate can also be increased. Accordingly, the function generator 134 outputs a large value within the range of 0 to 1 reduces the reduction amount of the opening area calculated by the function generator 131, and outputs a large opening area value.

The multiplier 138 accepts as inputs the pump reduction flow rate calculated by the function generator 133 and the value calculated by the function generator 134, and outputs a multiplied value as a pump reduction flow rate. Here, in the case where the lever operation signal 123 of the first operation device 6 is small, the regeneration flow rate is also small, and, therefore, it is required to set a pump reduction flow rate at a low value. For this reason, the function generator 134 outputs a small value within the range of 0 to 1 and outputs the pump reduction flow rate calculated by the function generator 133 as a further reduced value.

On the other hand, in the case where the lever operation signal 123 of the first operation device 6 is large, the regeneration flow rate is high, and, therefore, it is necessary to set the pump reduction flow rate to a large value. For this reason, the function generator 134 outputs a large value within the range of 0 to 1 reduces the reduction amount of the pump reduction flow rate calculated by the function generator 133, and outputs a large pump reduction flow rate value.

The function generator 135 calculates a coefficient to be used in the multiplier according to the lever operation signal 124 of the second operation device 10. The function generator 135 outputs a minimum value of 0 when the lever operation signal 124 is 0, increases its output as the lever operation signal 124 increases, and outputs 1 as a maximum value.

The multiplier 140 accepts as inputs the opening area calculated by the multiplier 136 and the value calculated by the function generator 135, and outputs a multiplied value as an opening area. Here, in the case where the lever operation signal 124 of the second operation device 10 is small, it is necessary to lower the piston rod speed of the arm cylinder 4, and, therefore, it is required to reduce the regeneration flow rate as well. For this reason, the function generator 135 outputs a small value within the range of 0 to 1 and outputs the opening area corrected by the multiplier 136 as a further reduced value.

On the other hand, in the case where the lever operation signal 124 of the second operation device 10 is large, it is necessary to raise the piston rod speed of the arm cylinder 4, and, therefore, the regeneration flow rate can also be increased. For this reason, the function generator 135 outputs a large value within the range of 0 to 1 reduces the reduction amount of the opening area corrected by the multiplier 136, and outputs a large opening area value.

The multiplier 142 accepts as inputs the pump reduction flow rate calculated by the multiplier 138 and the value calculated by the function generator 135, and outputs a multiplied value as a pump reduction flow rate. Here, in the case where the lever operation signal 124 of the second operation device 10 is small, the regeneration flow rate is also small, and, therefore, it is required to set the pump reduction flow rate at a small value. For this reason, the function generator 135 outputs a small value within the range of 0 to 1 and outputs the pump reduction flow rate corrected by the multiplier 138 as a further reduced value.

On the other hand, in the case where the lever operation signal 124 of the second operation device 10 is large, the regeneration flow rate is large, and it is necessary to set a pump reduction flow rate at a high value. In view of this, the function generator 135 outputs a large value within the range of 0 to 1, reduces the reduction amount of the pump reduction flow rate corrected by the multiplier 138, and outputs a large pump reduction flow rate value.

The function generator 139 calculates a pump required flow rate according to the lever operation signal 124 of the second operation device 10. The function generator 139 has a characteristic set in such a manner as to output a minimum level of flow rate from the hydraulic pump 1 in the case where the lever operation signal 124 is 0. This is for the purpose of ensuring a good response at the time when the operation lever 10*a* of the second operation device 10 is operated and for preventing seizure of the hydraulic pump 1. In addition, as the lever operation signal 124 increases, the delivery flow rate of the hydraulic pump 1 is increased, and the flow rate of the hydraulic fluid flowing into the arm cylinder 8 is increased. As a result, a piston rod speed of the arm cylinder 8 according to an operation amount is realized.

The adder 144 accepts as inputs the pump reduction flow rate calculated at the multiplier 142 and the pump required flow rate calculated by the function generator 139. In the adder 144, the pump reduction flow rate, or the regeneration flow rate, is subtracted from the pump required flow rate, to calculate a target pump flow rate.

An output from the multiplier 140 and an output from the adder 144 are inputted to the output conversion section 146, from which a solenoid valve command 222 to the solenoid proportional valve 22 and a tilting command 201 to the regulator 1*a* of the hydraulic pump 1 are outputted.

As a result, the solenoid proportional valve 22 converts the hydraulic fluid supplied from the pilot pump 3 into a desired pressure and outputs it to the operation section 17*a* of the regeneration control valve 17, so as to control the stroke of the regeneration control valve 17, thereby controlling the opening (opening area). In addition, the regulator 1*a* controls the tilting angle (capacity) of the hydraulic pump 1, whereby the delivery flow rate is controlled. As a result, the hydraulic pump 1 is controlled to reduce the capacity by an amount according to the regeneration flow rate of the hydraulic fluid supplied from the bottom-side of the boom cylinder 4 to the hydraulic fluid supply line 11*a*.

Operations of the control unit 27 will be described below.

With the operation lever 6*a* of the first operation device 6 operated in the boom lowering direction BD, the operation pilot pressure Pbd detected by the pressure sensor 23 is inputted to the control unit 27 as the lever operation signal 123. With the operation lever 10*a* of the second operation device 10 operated in the arm dumping direction AD, the operation pilot pressure Pad detected by the pressure sensor 24 is inputted to the control unit 27 as the lever operation signal 124. In addition, signals of the pressure in the bottom-side hydraulic chamber of the boom cylinder 4 and the delivery pressure of the hydraulic pump 1 that are detected respectively by the pressure sensors 25 and 26 are inputted to the control unit 27 as the bottom pressure signal 125 and the pump pressure signal 126.

The bottom pressure signal 125 and the pump pressure signal 126 are inputted to the adder 130 serving as a differential pressure calculation section, which calculates a differential pressure signal. The differential pressure signal is inputted to the function generator 131 and the function generator 133, which calculate an opening area of the regeneration-side line of the regeneration control valve 17 and a pump reduction flow rate, respectively.

The lever operation signal 123 is inputted to the function generator 134, which calculates a correction signal according to the lever operation amount, and outputs the signal to the multiplier 136 and the multiplier 138. The multiplier 136 corrects the opening area of the regeneration-side line outputted from the function generator 131, whereas the multiplier 138 corrects the pump reduction flow rate outputted from the function generator 133.

Similarly, when the lever operation signal 124 is inputted to the function generator 135, the function generator 135 calculates a correction signal according to the lever operation amount, and outputs the signal to the multiplier 140 and the multiplier 142. The multiplier 140 further corrects the corrected opening area of the regeneration-side line outputted from the multiplier 136, and outputs the corrected opening area to the output conversion section 146. The multiplier 142 further corrects the corrected pump reduction flow rate outputted from the multiplier 138, and outputs the corrected pump reduction flow rate to the adder 144.

The output conversion section 146 converts the corrected opening area of the regeneration-side line into the solenoid valve command 222, and outputs it to the solenoid proportional valve 22. By this, the stroke of the regeneration control valve 17 is controlled. As a result, the regeneration control valve 17 is set to an opening area according to the differential pressure between the pressure in the bottom-side hydraulic chamber of the boom cylinder 4 and the delivery pressure of the hydraulic pump 1, and the hydraulic fluid discharged from the bottom-side hydraulic chamber of the boom cylinder 4 is regenerated for the arm cylinder 8.

The lever operation signal 124 is inputted to the function generator 139, which calculates a pump required flow rate according to the lever operation amount and outputs it to the adder 144.

The pump required flow rate thus calculated and the pump reduction flow rate are inputted to the adder 144, which subtracts the pump reduction flow rate, or the regeneration flow rate, from the pump required flow rate to calculate a target pump flow rate, and outputs it to the output conversion section 146.

The output conversion section 146 converts the target pump flow rate into a tilting command 201 for the hydraulic pump 1, and outputs it to the regulator 1*a*. As a result, the arm cylinder 8 is controlled to a desired speed according to the operation signal (operation pilot pressure Pad) of the second operation device 10, and, in addition, the delivery flow rate of the hydraulic pump 1 is reduced by an amount according to the regeneration flow rate, whereby the fuel cost for an engine for driving the hydraulic pump 1 can be reduced, and energy savings can be realized.

By the above operations, the regeneration control valve 17 gradually increases the opening area of the regeneration-side line according to the differential pressure between the pressure in the bottom-side hydraulic chamber of the boom cylinder 4 and the delivery pressure of the hydraulic pump 1, so that the switching shock is suppressed and a favorable operability can be realized. In addition, when the above-mentioned differential pressure, the operation amount of the first operation device 6, and the operation amount of the second operation device 10 are all small, the opening area of the regeneration-side line of the regeneration control valve 17 is set to be small and the opening area of the tank-side line is set to be large, so that the tank-side flow rate is high even though the regeneration flow rate is low. Consequently, a piston rod speed of the boom cylinder desired by the operator can be secured.

On the other hand, when the differential pressure, the operation amount of the first operation device 6 and the operation amount of the second operation device 10 are large, the opening area of the regeneration-side line of the regeneration control valve 17 is set to be large and the opening area of the tank-side line is set to be small. Therefore, the piston rod speed of the boom cylinder can be restrained from becoming too high, and a piston rod speed of the boom cylinder desired by the operator can be secured. In addition, the delivery flow rate of the hydraulic pump 1 is reduced according to the regeneration flow rate, whereby a speed desired by the operator can be secured in regard of the piston rod speed of the arm cylinder 8 as well.

According to the first embodiment of the hydraulic drive system for a work machine of the present invention as described above, in the case where the hydraulic fluid discharged from the hydraulic actuator 4 is regenerated for driving the other hydraulic actuator 8, the opening of the regeneration control valve 17 is adjusted according to the differential pressure between the pressure of the hydraulic fluid discharged from the hydraulic actuator 4 and the pressure of the other hydraulic actuator 8, and, therefore, the switching shock is suppressed and a favorable operability can be realized.

Note that a case wherein the differential pressure calculation section of the control unit 27 reads the pressure of the hydraulic fluid discharged from the hydraulic actuator 4 and the pressure between the hydraulic pump 1 and the other hydraulic actuator 8 from the respective pressure sensors and calculates the differential pressure between these two pressures has been described in the present embodiment, but this configuration is not restrictive. For example, a configuration may be adopted wherein a differential pressure detection section as a differential pressure sensor for measuring the differential pressure between a discharge section of the hydraulic actuator 4 and a portion between the hydraulic pump 1 and the other hydraulic actuator 8 is provided, and the opening of the regeneration control valve 17 is adjusted according to the differential pressure outputted from the differential pressure sensing section.

Embodiment 2

Figure 5:
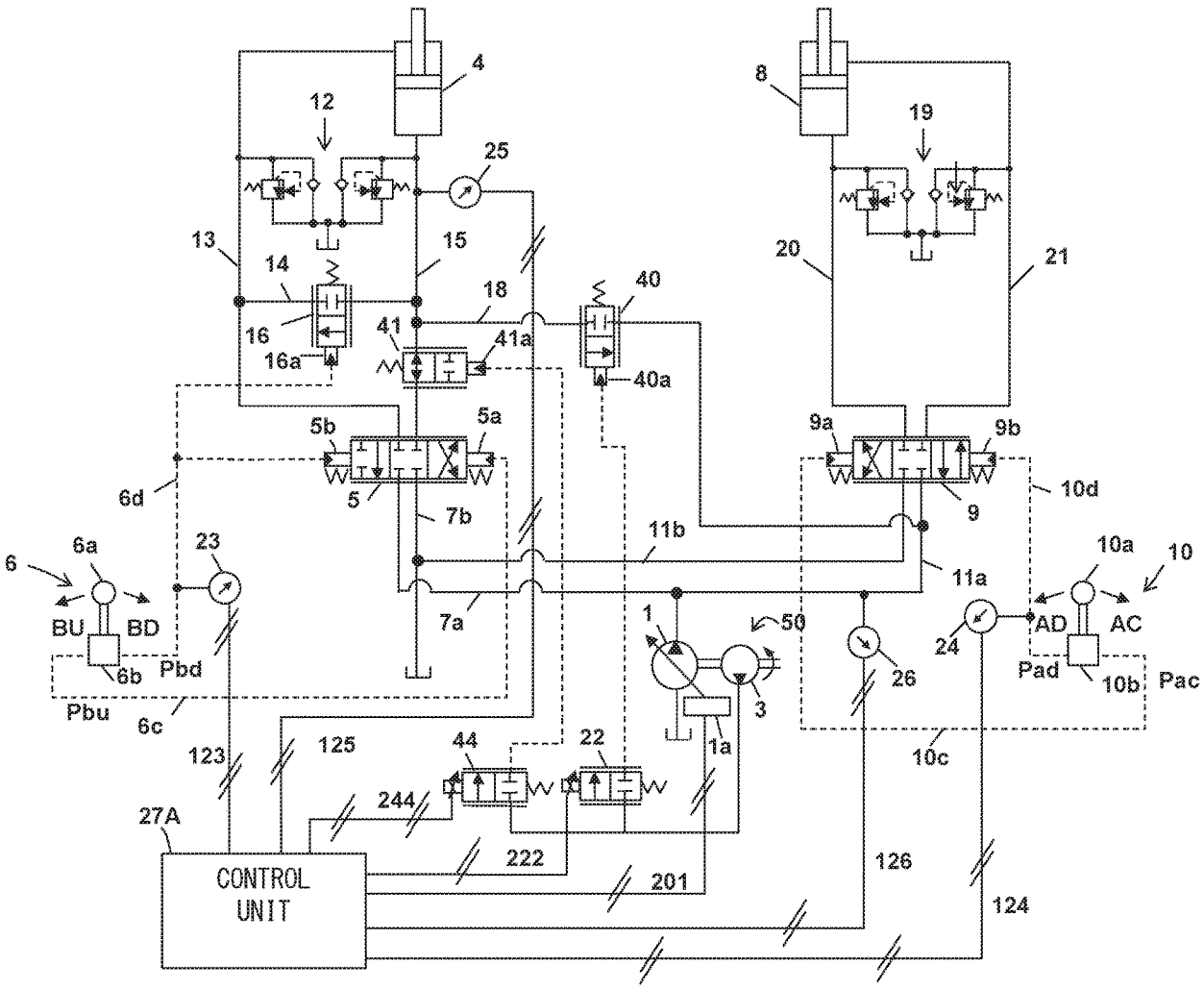
FIG. 5 is a schematic drawing of a control system showing a second embodiment of the hydraulic drive system for a work machine of the present invention.
Figure 6:
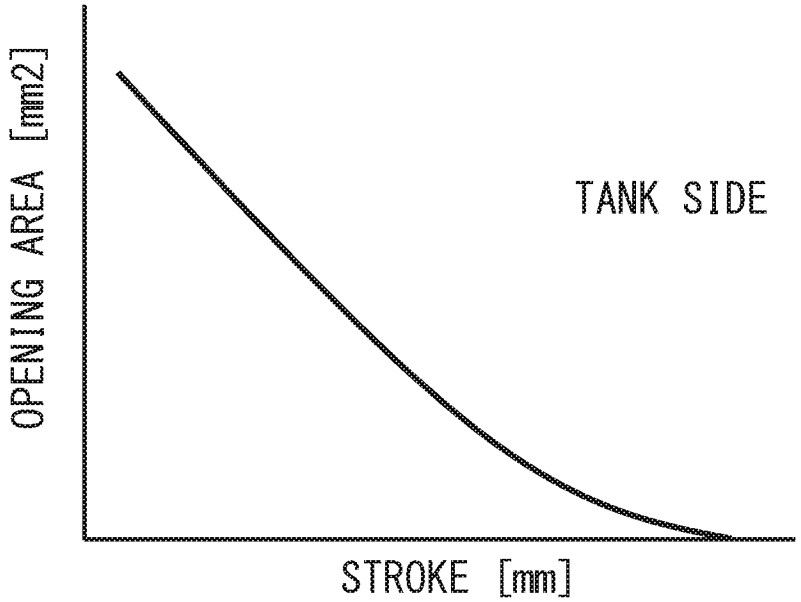
FIG. 6 is a characteristic diagram showing opening area characteristic of a tank-side control valve constituting the second embodiment of the hydraulic drive system for a work machine of the present invention.
Figure 7:
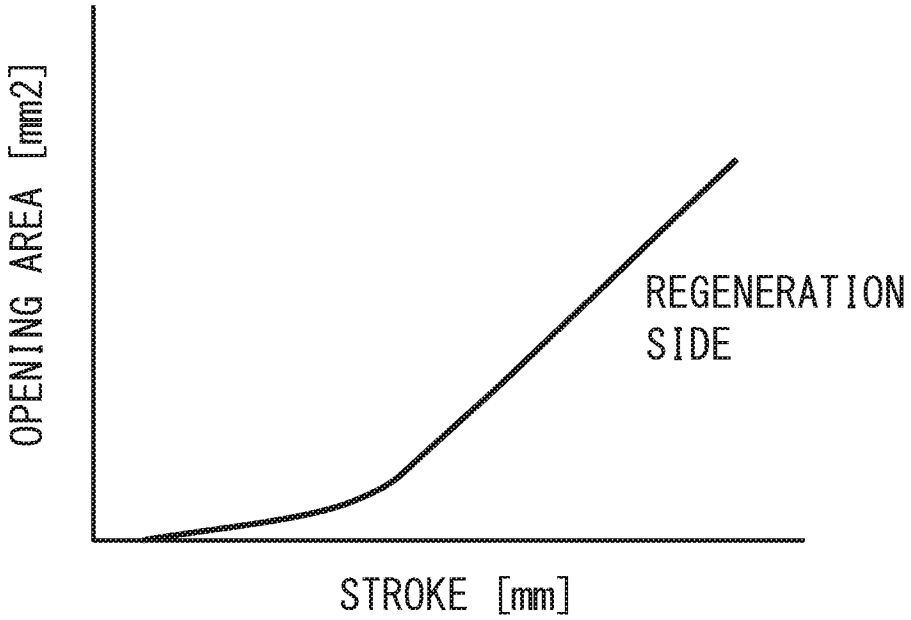
FIG. 7 is a characteristic diagram showing opening area characteristic of a regeneration-side control valve constituting the second embodiment of the hydraulic drive system for a work machine of the present invention.
Figure 8:
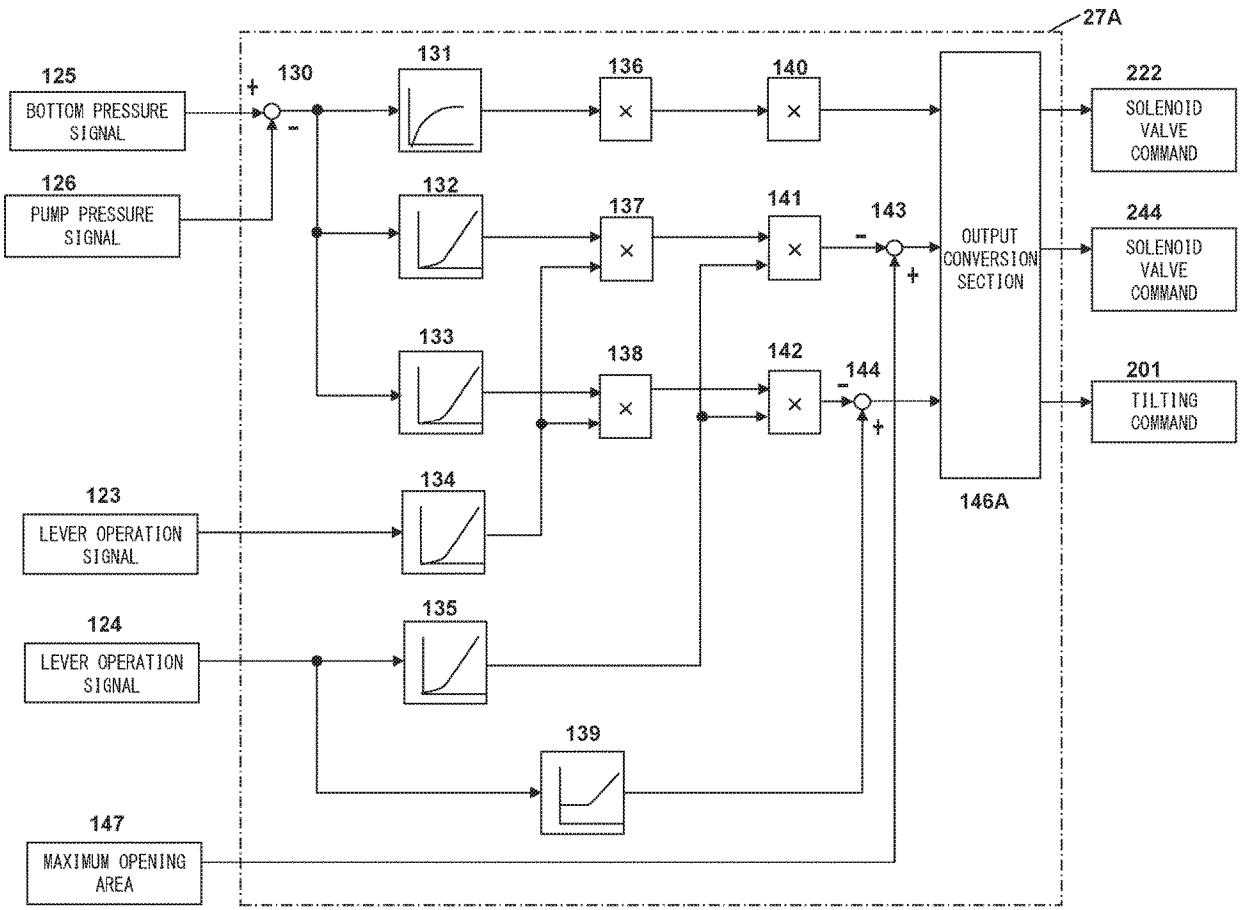
FIG. 8 is a block drawing of a control unit constituting the second embodiment of the hydraulic drive system for a work machine of the present invention.

A second embodiment of the hydraulic drive system for a work machine of the present invention will be described below referring to the drawings. FIG. 5 is a schematic drawing of a control system showing a second embodiment of the hydraulic drive system for a work machine of the present invention; FIG. 6 is a characteristic diagram showing opening area characteristic of a tank-side control valve constituting the second embodiment of the hydraulic drive system for a work machine of the present invention; FIG. 7 is a characteristic diagram showing opening area characteristic of a regeneration-side control valve constituting the second embodiment of the hydraulic drive system for a work machine of the present invention; and FIG. 8 is a block diagram of a control unit constituting the second embodiment of the hydraulic drive system for a work machine of the present invention. In FIGS. 5 to 8, the parts denoted by the same reference symbols as used in FIGS. 1 to 4 are the same parts as those in FIGS. 1 to 4, and, therefore, detailed descriptions of them will be omitted.

The second embodiment of the hydraulic drive system for a work machine of the present invention differs from the first embodiment in that a tank-side control valve 41 is provided as a discharge flow rate adjustment device in the bottom-side line 15 in place of the regeneration control valve 17 shown in FIG. 1, and that a regeneration-side control valve 40 is provided as a regeneration flow rate adjustment device in the regeneration line 18. The stroke of the tank-side control valve 41 is controlled by a solenoid proportional valve 44, and the stroke of the regeneration-side control valve 40 is controlled by the solenoid proportional valve 22.

The solenoid proportional valve 44 is operated by a control command from the control unit 27. The solenoid proportional valve 44 converts the hydraulic fluid supplied from the pilot pump 3 into a desired pressure and outputs it to an operation section 41*a* of the tank-side control valve 41, so as to control the stroke of the tank-side control valve 41, thereby controlling the opening (opening area). In addition, the solenoid proportional valve 22 converts the hydraulic fluid supplied from the pilot pump 3 into a desired pressure and outputs it to an operation section 40*a* of the regeneration-side control valve 40, so as to control the stroke of the regeneration-side control valve 40, thereby controlling the opening (opening area).

FIG. 6 shows opening area characteristic of the tank-side control valve 41, and FIG. 7 shows opening area characteristic of the regeneration-side control valve 40. In these figures, the horizontal axis represents spool stroke of each valve, and the vertical axis represents opening area. These characteristics are formed to be equivalent to those obtained by separating the characteristic of the regeneration control valve 17 in the first embodiment shown in FIG. 3 into characteristics on the tank side and the regeneration side.

In the present embodiment, the opening area of the regeneration-side line and the opening area of the tank-side line can be controlled independently and finely, so that a further improvement in fuel cost can be realized.

In addition, the hydraulic drive system in the present embodiment includes a control unit 27A in place of the control unit 27 in the first embodiment shown in FIG. 1.

FIG. 8 is a block diagram showing a control logic of the control unit 27A in the second embodiment. Note that descriptions of the same control elements as those in FIG. 4 will be omitted.

As shown in FIG. 8, the control unit 27A includes a function generator 132, a multiplier 137, a multiplier 141, an adder 143, an output conversion section 146A, in addition to the adder 130, the function generator 131, the function generator 133, the function generator 134, the function generator 135, the multiplier 136, the multiplier 138, the function generator 139, the multiplier 140, the multiplier 142, and the adder 144 in the first embodiment shown in FIG. 4.

Here, the adder additionally provided forms a logic that calculates a solenoid valve command 244 for controlling the tank-side control valve 41. A solenoid valve command 222 for controlling the regeneration-side control valve 40 is based on the same concept as that for the solenoid valve command 222 for controlling the regeneration control valve 17 shown in the first embodiment, and description thereof is therefore omitted.

In the present embodiment, the opening area of the regeneration-side line and the opening area of the tank-side line can be finely adjusted, according to the differential pressure between the pressure in the bottom-side hydraulic chamber of the boom cylinder 4 and the delivery pressure of the hydraulic pump 1 that is calculated by the adder 130 serving as the differential pressure calculation section, a lever operation signal 123 as an operation amount for the first operation device 6, and a lever operation signal 124 as an operation amount for the second operation device 10. Therefore, a further improvement in fuel cost can be realized.

In FIG. 8, the function generator 132 calculates an opening area of the tank-side line to be throttled by the tank-side control valve 41 according to the differential pressure signal obtained by the adder 130. According to the opening area characteristic of the tank-side control valve 41 shown in FIG. 6, the opening area is at a maximum when the spool stroke is at a minimum, and the opening area decreases as the stroke gradually increases. On the other hand, as shown in FIG. 7, the opening area characteristic of the regeneration-side control valve 40 is such that the opening area is at a minimum when the spool stroke is at a minimum, and the opening area increases as the stroke gradually increases.

In view of these characteristics, in the present embodiment, regeneration is conducted by opening the regeneration-side control valve 40 and performing such a control as to throttle the tank-side control valve 41 in such a manner that the piston rod speed of the boom cylinder 4 does not become too high.

Returning to FIG. 8, in the case where the differential pressure signal obtained at the adder 130 is small, the regeneration-side control valve 40 is closed, and, therefore, the function generator 132 is set to output a small value such as not to throttle the tank-side control valve 41. Conversely, where the differential pressure signal is large, the function generator 132 outputs a large value such as to throttle the tank-side control valve 41, thereby to prevent the piston rod speed of the boom cylinder from becoming too high.

The multiplier 137 accepts as inputs the throttling amount of the tank-side opening area calculated by the function generator 132 and the value calculated by the function generator 134, and outputs a multiplied value. Here, in the case where the lever operation signal 123 of the first operation device 6 is small, the regeneration-side control valve 40 is closed, and, therefore, a control is conducted to open the tank-side control valve 41 such as to secure a piston rod speed of the boom cylinder 4. For this purpose, the function generator 134 outputs a small value within the range of 0 to 1 so as to output a small throttling amount value.

On the other hand, in the case where the lever operation signal 123 of the first operation device 6 is large, the regeneration side control valve 40 is open, and, therefore, a control is conducted to close the tank-side control valve 41 such as to prevent the piston rod speed of the boom cylinder 4 from becoming too high. For this purpose, the function generator 134 outputs a large value within the range of 0 to 1 so as to output a large throttling amount value.

The multiplier 141 accepts as inputs the throttling amount for the tank-side opening area calculated by the multiplier 137 and the value calculated by the function generator 135, and outputs a multiplied value. Here, in the case where the lever operation signal 124 of the second operation device 10 is small, the regeneration-side control valve 40 is closed, and, therefore, a control is conducted to open the tank-side control valve 41 for securing a piston rod speed of the boom cylinder 4. For this purpose, the function generator 134 outputs a small value within the range of 0 to 1 so as to output a small throttling amount value.

On the other hand, where the lever operation signal 124 of the second operation device 10 is large, the regeneration-side control valve 40 is open, and, therefore, a control is conducted to close the tank-side control valve 41 for preventing the piston rod speed of the boom cylinder 4 from becoming too high. For this purpose, the function generator 135 outputs a large value within the range of 0 to 1 so as to output a large throttling amount value.

A maximum opening area signal 147 for the tank-side control valve 41 and the throttling amount for the tank-side opening area calculated by the multiplier 141 are inputted to the adder 143, in which the throttling amount for the tank-side opening is subtracted from the maximum opening area to calculate a target opening for the tank-side control valve 41.

An output from the adder 143 is inputted to the output conversion section 146A, which outputs a solenoid valve command 244 to the solenoid proportional valve 44. As a result, the solenoid proportional valve 44 converts the hydraulic fluid supplied from the pilot pump 3 into a desired pressure and outputs it to the operation section 41*a* of the tank-side control valve 41, so as to control the stroke of the tank-side control valve 41, thereby controlling the opening (opening area).

In this instance, the output conversion section 146A converts the corrected opening area of the regeneration-side line into the solenoid valve command 222, and outputs it to the solenoid proportional valve 22. By this, the stroke of the regeneration-side control valve 40 is controlled. As a result, the regeneration-side control valve 40 is set to an opening area according to the differential pressure between the pressure in the bottom-side hydraulic chamber of the boom cylinder 4 and the delivery pressure of the hydraulic pump 1, and the hydraulic fluid discharged from the bottom-side hydraulic chamber of the boom cylinder 4 is regenerated to the arm cylinder 8.

In addition, the output conversion section 146A converts a target pump flow rate into a tilting command 201 for the hydraulic pump 1, and outputs it to the regulator 1*a*. By this, the arm cylinder 8 is controlled to a desired speed according to an operation signal (operation pilot pressure Pad) of the second operation device 10. In addition, the delivery flow rate of the hydraulic pump 1 is reduced by an amount according to the regeneration flow rate, whereby the fuel cost for the engine for driving the hydraulic pump 1 can be reduced, and energy savings can be realized.

According to the second embodiment of the hydraulic drive system for a work machine of the present invention described above, the same effects as those of the aforementioned first embodiment can be obtained.

Besides, according to the second embodiment of the hydraulic drive system for a work machine of the present invention described above, the opening area of the regeneration-side line and the opening area of the tank-side line can be controlled independently, so that fine control can be achieved, and the regeneration flow rate can be increased maximally. As a result, the fuel cost reducing effect can be further enhanced.

In addition, the present invention is not limited to the above embodiments, and various modifications are encompassed therein without departing from the scope of the gist thereof. For instance, while a case where the present invention is applied to a hydraulic excavator has been described in the above embodiments, the present invention is also applicable to other work machines such as hydraulic cranes and wheel loaders which have a configuration wherein when a first operation device is operated in the direction of falling of a first driven body by its own weight, a hydraulic cylinder discharges the hydraulic fluid from the bottom side and sucks the hydraulic fluid from the rod side by the falling of the first driven body by its own weight.

DESCRIPTION OF REFERENCE SYMBOLS

1: Hydraulic pump
1*a*: Regulator
3: Pilot pump
4: Boom cylinder (First hydraulic actuator)
5: Control valve
6: First operation device
6*a*: Operation lever
6*b*: Pilot valve
6*c*, 6*d*: Pilot line
8: Arm cylinder (Second hydraulic actuator)
9: Control valve
10: First operation device
10*a*: Operation lever
10*b*: Pilot valve
10*c*, 10*d*: Pilot line
7*a*, 11*a*: Hydraulic fluid supply line
7*b*, 11*b*: Tank line
12: Over-load relief valve with make-up
13: Rod-side line
14: Communication line
15: Bottom-side line
16: Communication control valve
17: Regeneration control valve
18: Regeneration line
19: Over-load relief valve with make-up
20: Bottom-side line
21: Rod-side line
22: Solenoid proportional valve
23: Pressure sensor
24: Pressure sensor
25: Pressure sensor
26: Pressure sensor
27: Control unit
123: Lever operation signal
124: Lever operation signal
125: Bottom pressure signal

126: Pump pressure signal
130: Adder
131: Function generator
133: Function generator
134: Function generator
135: Function generator
136: Multiplier
138: Multiplier
139: Function generator
140: Multiplier
142: Multiplier
144: Adder
146: Output conversion section
201: Tilting command
222: Solenoid valve command
203: Front work implement
205: Boom (First driven body)
206: Arm (Second driven body)
207: Bucket

The invention claimed is:

1. A hydraulic drive system for a work machine, comprising:

a hydraulic pump device; a first hydraulic actuator that is supplied with hydraulic fluid from the hydraulic pump device and drives a first driven body; a second hydraulic actuator that is supplied with the hydraulic fluid from the hydraulic pump device and drives a second driven body; a first flow rate adjustment device that controls flow of the hydraulic fluid supplied from the hydraulic pump device to the first hydraulic actuator; a second flow rate adjustment device that controls flow of the hydraulic fluid supplied from the hydraulic pump device to the second hydraulic actuator; a first operation device that outputs an operation signal for commanding an operation of the first driven body to switch over the first flow rate adjustment device; and a second operation device that outputs an operation signal for commanding an operation of the second driven body to switch over the second flow rate adjustment device, the first hydraulic actuator being a hydraulic cylinder that discharges the hydraulic fluid from a bottom-side hydraulic chamber and sucks the hydraulic fluid from a rod-side hydraulic chamber by falling of the first driven body by its own weight when the first operation device is operated in a direction of falling of the first driven body by its own weight, wherein the hydraulic drive system further comprises:

a regeneration line that connects the bottom-side hydraulic chamber of the hydraulic cylinder to a portion between the hydraulic pump device and the second hydraulic actuator, a regeneration flow rate adjustment device that supplies at least part of the hydraulic fluid discharged from the bottom-side hydraulic chamber of the hydraulic cylinder to the portion between the hydraulic pump device and the second hydraulic actuator through the regeneration line;

a differential pressure calculation section that reads a pressure in the bottom-side hydraulic chamber of the hydraulic cylinder detected by a first pressure sensor for detecting the pressure in the bottom-side hydraulic chamber of the hydraulic cylinder and a pressure between the hydraulic pump device and the second hydraulic actuator detected by a second pressure sensor for detecting the pressure between the hydraulic pump device and the second hydraulic actuator and calculates a differential pressure, or a differential pressure sensor that detects the differential pressure between the pressure in the bottom-side hydraulic chamber of the hydraulic cylinder and the pressure between the hydraulic pump device and the second hydraulic actuator; and a control unit that controls the regeneration flow rate adjustment device such as to gradually increase the flow rate of the hydraulic fluid flowing through the regeneration line according to an increase in the differential pressure calculated by the differential pressure calculation section or the differential pressure detected by the differential pressure sensor.

2. The hydraulic drive system for a work machine according to claim 1, wherein the hydraulic pump device includes at least one variable displacement hydraulic pump, the variable displacement hydraulic pump comprises a delivery flow rate adjustment device that enables adjustment of delivery flow rate, and the control unit controls the delivery flow rate adjustment device for controlling the delivery flow rate of the hydraulic pump device according to the differential pressure calculated by the differential pressure calculation section or the differential pressure detected by the differential pressure sensor.

3. The hydraulic drive system for a work machine according to claim 1, further comprising a discharge flow rate adjustment device that discharges to a tank at least part of the hydraulic fluid discharged from the bottom-side hydraulic chamber of the hydraulic cylinder, wherein the control unit controls the discharge flow rate adjustment device for controlling the discharge flow rate of the hydraulic fluid discharged to the tank according to the differential pressure calculated by the differential pressure calculation section or the differential pressure detected by the differential pressure sensor.

4. The hydraulic drive system for a work machine according to claim 2, further comprising a discharge flow rate adjustment device that discharges to a tank at least part of the hydraulic fluid discharged from the bottom-side hydraulic chamber of the hydraulic cylinder, wherein the control unit controls the discharge flow rate adjustment device for controlling the discharge flow rate of the hydraulic fluid discharged to the tank according to the differential pressure calculated by the differential pressure calculation section or the differential pressure detected by the differential pressure sensor.

5. The hydraulic drive system for a work machine according to claim 4, further comprising a first operation amount sensor that detects an operation amount of the first operation device and a second operation amount sensor that detects an operation amount of the second operation device, wherein the control unit reads the operation amount of the first operation device detected by the first operation amount sensor and the operation amount of the second operation device detected by the second operation amount sensor, and controls at least one of the regeneration flow rate adjustment device, the discharge flow rate adjustment device or the delivery flow rate adjustment device according to the operation amount of at least one of the first operation device or the second operation device.

6. The hydraulic drive system for a work machine according to claim 5, wherein the control unit controls the regeneration flow rate adjustment device such as to increase the flow rate of the hydraulic fluid flowing through the regeneration line according to an increase in the differential pressure calculated by the differential pressure calculation section or the differential pressure detected by the differential pressure sensor when the operation amount of at least one of the first operation device or the second operation device is a fixed amount.

7. The hydraulic drive system for a work machine according to claim 5, wherein the control unit controls the regeneration flow rate adjustment device such as to increase the flow rate of the hydraulic fluid flowing through the regeneration line according to the operation amount of the first operation device or the operation amount of the second operation device when the differential pressure calculated by the differential pressure calculation section or the differential pressure detected by the differential pressure sensor is a fixed amount.

8. The hydraulic drive system for a work machine according to claim 4, wherein the regeneration flow rate adjustment device and the discharge flow rate adjustment device are one regeneration control valve having a regeneration-side restrictor and a discharge-side restrictor.

9. The hydraulic drive system for a work machine according to claim 4, wherein the regeneration flow rate adjustment device is a regeneration valve that adjusts regeneration flow rate, and the discharge flow rate adjustment device is a discharge valve that adjusts discharge flow rate.

* * * * *